US005230509A

United States Patent [19]

Chavez

[11] Patent Number: 5,230,509

[45] Date of Patent: Jul. 27, 1993

[54] VERSATILE PUTTER

[76] Inventor: Angel R. Chavez, 2411 NE. 9th Ter., Pompano Beach, Fla. 33064

[21] Appl. No.: 867,454

[22] Filed: Apr. 13, 1992

[51] Int. Cl.[5] ..... A63B 53/04; A63B 69/36

[52] U.S. Cl. ..... 273/171; 273/173; 273/194 B

[58] Field of Search ..... 273/167-175, 273/79, 77 R, 194 A, 194 B, 164.1, 186.2, 187.4, 187.6, 162 R, 162 F

[56] References Cited

U.S. PATENT DOCUMENTS

| | | | |
|---|---|---|---|
| 1,135,621 | 4/1915 | Roberts | 273/79 |
| 1,320,163 | 10/1919 | Maurice | 273/171 |
| 2,332,342 | 10/1943 | Reach | 273/171 |
| 2,451,262 | 10/1948 | Watkins | 273/171 |
| 2,503,506 | 4/1950 | Miller | 273/194 A X |
| 2,530,446 | 11/1950 | Beardsley | 273/168 X |
| 3,220,733 | 11/1965 | Saleeby | 273/171 |
| 3,333,854 | 8/1967 | White | 273/173 X |
| 4,121,832 | 10/1978 | Ebbing | 273/171 |
| 4,130,282 | 12/1978 | Pelz | 273/171 X |
| 4,884,808 | 12/1989 | Retzer | 273/79 X |

*Primary Examiner*—V. Millin
*Assistant Examiner*—Sebastiano Passaniti

[57] ABSTRACT

An improved putter-type golf club head configuration including a heel, toe, upper surface, bottom surface, rear surface and ball striking face having a center of percussion centrally located. The improvement includes the T-formation located at the rear portion of the club head with a weight that is designed to interlock and provides support to stop projection designed in form and alignment of both club head and weight. Secured in movement by a machine screw at base of club head, which is centrally positioned between the T-formation and toe, in order to prevent movement of weight by the applied pressure to the inner wall of club head.

2 Claims, 1 Drawing Sheet

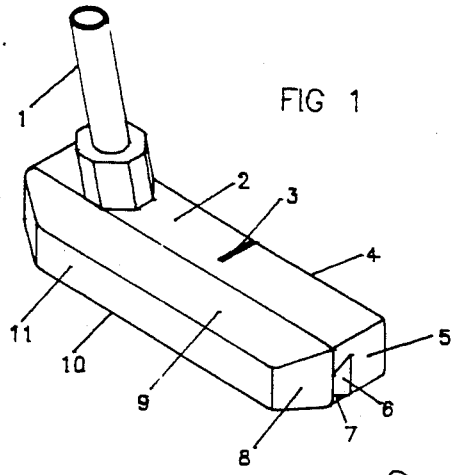
FIG 1
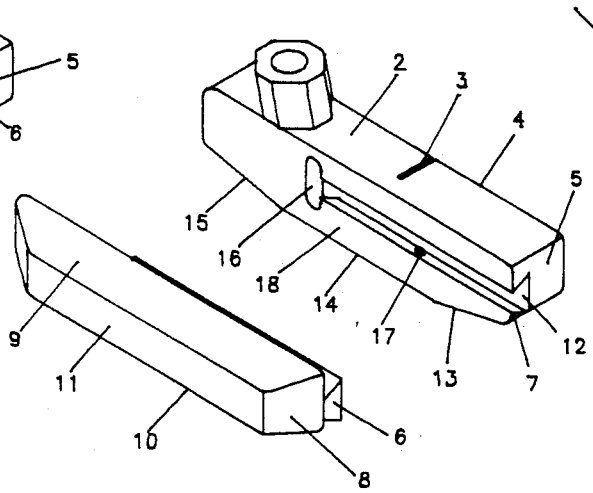
FIG 2
ANGEL RAMIRO CHAVEZ
INVENTOR
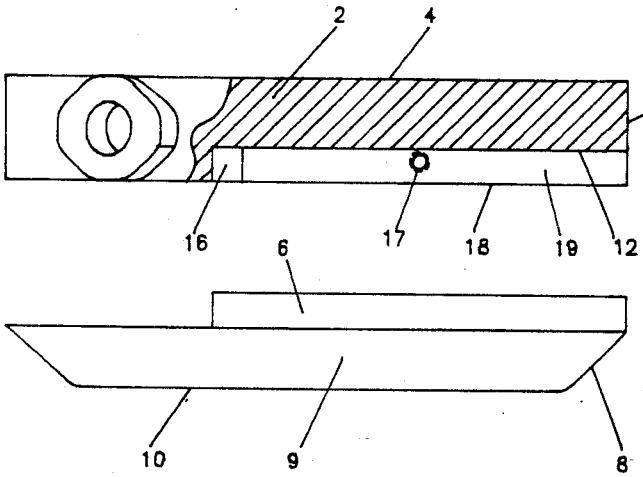
FIG 3
FIG 4
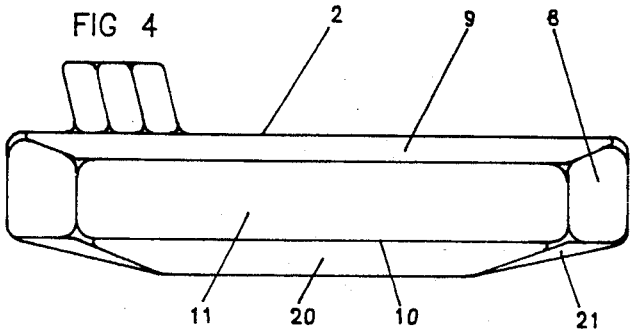
FIG 5
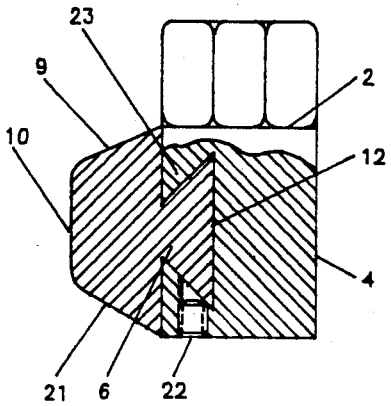

VERSATILE PUTTER

RELATED ART

There have been several different forms of putters with various forms of weight adjustments for purposes of providing balance in both appearance and physical weight of the putter which are here disclosed in U.S. Pat. Nos. 3,220,733, 2,530,446, 1,320,163, 2,503,506, 4,655,459, and 3,191,936. However, these previously known forms of putters do not include the overall combination of structural and operational features incorporated in the present invention.

BACKGROUND OF THE INVENTION

The present invention relates to a golf club head design, but more specifically, to golf club head having a design so uniquely structured and the versatility of weight distribution.

It is well known that many individuals require golf clubs having different weight specifications and certain weight distribution depending on the individuals likes as well as the physical capabilities of the individual and this is also true when a golfer encounters different courses whereby the golfer may require adjustment in the weight characteristic of the club. This is especially true where the putter is concerned, since it is used mainly on the green, whereby a short stroke is required to direct the ball to the cup. For example, if the putting surface is fast due to the shortness of the grass, then a lightweight would be considered more desirable for a more effective result. On the other hand, when the surface is slow, this may be the result of rain or recent watering causing the golfer to adjust to a heavier weight. One must also consider the physical, mental, and visual characteristics of each individual golfer. Some individuals who have stronger physical ability need only adjust the weight depending on the surface at play, rather than to try and adjust the force when striking the ball. By making the necessary adjustments as required at time of play, the individual can maintain the same mental and visual attitude when striking the ball on a fast or slow surface.

BRIEF DESCRIPTION OF THE INVENTION

The present invention provides a golf club head structure which features a design which enables the attachment and detachment of a weight of the golfers desire, and which will retain the weight in position of the club head and providing a balanced formation in relation to the club head.

An object of the present invention is to provide a structural design of the putter head providing a T-formation symmetrically located to interlock the weight and secured in position by interlocking features and a machine screw at base to prevent movement while in use.

Another feature of the present invention is the design of the weight which features an interlocking dovetail projection conforming to the putter head thereto, and which the weight is distributed equally throughout the rear portion of the putter head and contour design of weight and putter to prevent any possible injury from the changing of weights. The versatility of the weights is an important feature of the design and the weights are easily constructed and are inexpensive to manufacture.

DESCRIPTION OF THE DRAWINGS

FIG. 1 is a perspective view of a putter incorporating the attached weight of the present invention therein;

FIG. 2 is an exploded group angle view illustration of the putter head and the attachable weight in their aspect;

FIG. 3 is an exploded group overview illustration of putter head and the attachable weight in their aspect with structural design representing the insert of the machine screw for securing weight to putter and T-formation for stopping weight at point of interlocking with putter head as illustrated in FIG. 2 of same;

FIG. 4 is a rear view of weight and putter incorporated and as illustrated in FIG. 1 indicating elevations of heel and toe and weight design;

FIG. 5 is a crosswise view of the interlocking weight and putter head by means of dovetail in FIG. 1.

DESCRIPTION OF THE PREFERRED EMBODIMENTS

Referring now more specifically to the drawings, the numeral 10 designates the weight of the present invention and the numeral 2 designates the putter head in a rectangular configuration with a flat but slight elevation surface 4 for engaging ball. Numeral 1 designates the putter shaft which is conventional in form. Numeral 16 designates the T-formation which part of the invention which assists in securing weight 10 at point of impact and supported by machine screw 17 at center base of putter head where applied pressure from machine screw 17 upon weight dovetail 6 and dovetail cut 7 of putter head 2.

The putter head 2 is illustrated in FIG. 2 and FIG. 3 respectfully, designates a flat surface of rear area or smooth in conjunction with weight 10 to be engaged at point of entry at toe area of putter head. Putter head 2 as illustrated in FIG. 2 illustrates a T-formation 16 cut which supports the continuous flow of weight 10 to a stopping along the dovetail cut 7 of the putter head 2 for engaging weight 10 which is also constructed in a dovetail configuration for interlocking thereto.

The longitudinal groove 12 extending from toe of putter head 2 having a smooth surface of putter head which extends to T-formation 16 thereby having the weight 10 engaged to putter head 2 by sliding on the flat surface of 12 of the dovetail projection 6 with inclined dovetail groove 7. The rear face of putter head 2 is smooth as indicated by numeral 18 from heel to toe which also provides a smooth sliding effect of putter head 2 and weight 10. The attached weight 10 being an elongated solid body 9 having equal length as that of putter head 2 to align with the top and bottom surfaces smoothly. The end edges of putter head 2 is parallel to weight 10 for alignment with the flat end edges of numeral 5 and 6 respectively as illustrated in FIGS. 1 and 5 to each other.

The inner surface of body numeral 9 is provided with a projection as indicated by numeral 6 longitudinally, which has a similar flat surface as that of numeral 12 for matching engagement and also the side edges of projection 6 which converge away from the flat surface of said projection for corresponding engagement of the inclined surface of numeral 7 and projection dovetail of numeral 6 for an interlocking relationship.

The rear portion of weight body 9 is curved with slight angles as illustrated by numeral 8, 20 and 21 in FIGS. 4 and 5 of design and corresponding angles from end to end and top to bottom therin. For purposes of securing weight 10 in position to main putter head 2 there is bore 17 which is centrally located at the base of putter head 2 and said bore is again centrally located between T-formation and toe of putter head 2 for which a machine screw 22 is positioned for securing and preventing movement or dislodging of weight 10 and putter head 2. The machine screw when threaded into bore 22 creates pressure against projection 6 thereby applying pressure of the interlocking process of putter head 2 and weight 10. By minimal release of machine screw and relieving pressure of projection 6 of weight 10 this enable it to slide in a longitudinal form. The sliding process is indicated by the joining weight 10 and putter head 2, and the interlocking process of projection numeral 6 and dovetail connection of putter head 2 of numerals 7 and 23 commencing at the toe of putter head 2 and ending the sliding process at 16 the T-formation. The configuration of the weights will not have any effect on the pressure applied by the machine screw upon application of varied weights, since the construction of the putter head 2 and weight 10 are machined uniformly for interlocking all in the same manner and secured. The contruction of putter head 2 and weight 10 are such that there are minimal rough or harmful portions in the construction when engaging in the removal of units from each other in the sliding process.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim is:

1. A golf club head comprising a body having a generally rectangular configuration and having a ball striking face, a rear face disposed generally opposite to said ball striking face, a toe, a heel and a base;

said club head body having a longitudinal groove having an undercut portion formed in said rear face; said groove and said undercut portion extending from said toe towards said heel and terminating at a location along said rear face between said heel and the longitudinal center of the club head body;

a removeably secureable weight for attachment to the rear face of said club head body; said weight having a projection which is longitudinal in form for interlocking engagement with said undercut portion of said groove;

said rear face including a vertical cut disposed at said location of termination of said groove, whereby said groove and said vertical cut collectively define a T-formation, whereby said weight is slidable along the groove in mating relationship with said undercut portion such that one end of said projection of said weight rests in abutting relationship against said T-formation;

means for interconnecting said projection to said groove for locking the weight to the club head body; said means including a threaded bore extending vertically from the base of the club head body; said bore extending into said undercut portion;

a threaded machine screw movable within said threaded bore and dimensioned to extend upwardly into said undercut portion, whereby the pressure exerted against the projection by the threaded machine screw upon tightening thereof secures the projection to the club head body and prevents lateral sliding movement of the weight.

2. A golf club head as defined in claim 1 wherein said groove is dovetail in configuration with the projection of the weight being of corresponding dovetailed configuration.

* * * * *